US012059077B2

(12) United States Patent
Bouche

(10) Patent No.: US 12,059,077 B2
(45) Date of Patent: Aug. 13, 2024

(54) ROCKING CHAIR MODIFICATION SYSTEM

(71) Applicant: KRUEGER INTERNATIONAL, INC., Green Bay, WI (US)

(72) Inventor: Timothy J. Bouche, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 81 days.

(21) Appl. No.: 17/943,681

(22) Filed: Sep. 13, 2022

(65) Prior Publication Data

US 2024/0081532 A1 Mar. 14, 2024

(51) Int. Cl.
*A47C 3/029* (2006.01)

(52) U.S. Cl.
CPC ..... *A47C 3/029* (2013.01)

(58) Field of Classification Search
CPC ..... A47C 3/029
See application file for complete search history.

(56) References Cited

U.S. PATENT DOCUMENTS 921,813 A * 5/1909 Druhman ..... A47C 3/029 297/133
1,228,521 A * 6/1917 Bell ..... A47C 3/029 297/133
1,231,151 A * 6/1917 Gerrard ..... A47C 3/029 297/133
1,535,298 A * 4/1925 Drabinsky ..... A47C 3/029 297/133
2,052,715 A * 9/1936 Kistemacher ..... A47C 3/029 297/272.1

(Continued)

FOREIGN PATENT DOCUMENTS

CN 201700777 U 1/2011
CN 202234062 U 5/2012
CN 107467939 A 12/2017

OTHER PUBLICATIONS

Alumni Explorer Rocker Chair. Alumni Educational Solutions. Accessed at https://www.alumnicf.com/ecommerce/seating/explorer/Explorer-Rocker-Chair.htm on Sep. 13, 2022.

(Continued)

*Primary Examiner* — David R Dunn
*Assistant Examiner* — Tania Abraham
(74) *Attorney, Agent, or Firm* — Andrus Intellectual Property Law, LLP

(57) ABSTRACT

A system for converting a stationary chair into a rocking chair. The chair includes legs that include a horizontal leg portion located near the floor. The system includes a pair of rocking assemblies that each can be mounted to one of a pair of horizontal leg portions of the chair. The rocking assemblies each include a pair of rocker brackets that can be connected to each other and entrap the horizontal leg portion between the pair of rocker brackets. Each of the rocker brackets includes a rocker surface that has an arcuate shape and extends between a front end and a back end with a fulcrum point between the front and back ends. The fulcrum point contacts the floor and the rocker brackets allow the chair to rock along the rocker surfaces. The pair of rocker brackets can be selectively installed upon and removed from the chair legs.

17 Claims, 8 Drawing Sheets

(56) References Cited

U.S. PATENT DOCUMENTS

| | | | | | |
|---|---|---|---|---|---|
| 2,662,580 | A * | 12/1953 | Gottfried | A47C 3/029 | 297/411.42 |
| 4,079,991 | A | 3/1978 | Harris | | |
| 4,126,353 | A | 11/1978 | Clough | | |
| 4,285,543 | A * | 8/1981 | Clark | A47C 3/029 | 297/133 |
| 5,486,034 | A * | 1/1996 | Dalke | A47C 13/00 | 297/133 |
| 5,702,152 | A | 12/1997 | Shaw | | |
| 5,839,781 | A * | 11/1998 | Knape | A47C 13/00 | 297/133 |
| 6,086,147 | A | 7/2000 | Gladstone | | |
| 6,328,378 | B1 | 12/2001 | Erickson | | |
| 6,416,123 | B1 | 7/2002 | Bell | | |
| 6,877,805 | B1 * | 4/2005 | Steadman | A47D 1/10 | 297/133 |
| 7,007,959 | B1 * | 3/2006 | Lu | A47D 13/043 | 280/87.051 |
| 7,147,284 | B2 * | 12/2006 | Mills | A47C 3/029 | 297/258.1 |
| 9,192,247 | B1 * | 11/2015 | Lu | A47D 13/102 | |
| 10,130,179 | B2 | 11/2018 | Clardy et al. | | |
| 11,193,519 | B2 | 12/2021 | Griggs, Jr. | | |
| 2004/0046427 | A1 * | 3/2004 | Perego | A47D 1/023 | 297/148 |
| 2007/0063558 | A1 * | 3/2007 | Stewart | A47C 3/029 | 297/260.2 |
| 2016/0120316 | A1 * | 5/2016 | Kassanoff | A47C 3/04 | 297/451.3 |
| 2019/0313797 | A1 * | 10/2019 | Frankel | A47C 3/02 | |
| 2021/0393034 | A1 * | 12/2021 | Sun | A47C 4/283 | |

OTHER PUBLICATIONS

Mooreco Hierarchy Rocker Chair. Mooreco Inc. Accessed at https://www.moorecoinc.com/product/ hierarchy-rocker-chair/ on Sep. 13, 2022.

Columbia Omnia Rocker. Columbia Manufacturing Inc. Accessed at https://www.columbiamfginc.com/product/omnia-rocker on Sep. 13, 2022.

Usacapitol 3708R Cantilever Rocker. USA Capitol. Accessed at https://usacapitol.com/product/3708r/ on Sep. 13, 2022.

Artcobell Alphabet Rocker. Artcobell. Accessed at https://catalog.artcobell.com/products/rocker on Sep. 13, 2022.

Scholarcraft 5100 Series Rocker. Scholarcraft. Accessed at https://www.scholarcraft.com/2thrive/2thrive5100rocker on Sep. 13, 2022.

Virco Zuma Rocking Chair. Virco. Accessed at https://www.virco.com/zuma-series-rocking chair on Sep. 13, 2022.

* cited by examiner

ROCKING CHAIR MODIFICATION SYSTEM

BACKGROUND

The present disclosure generally relates to a system to modify a standard, non-rocking chair into a rocking chair. More specifically, the present disclosure relates to a system that includes a pair of rocker assemblies that can each be mounted to a ground engaging leg portion of a non-rocking standard chair to convert the standard chair to a rocking chair.

Presently, different types of stationary chairs are used in educational settings for students in the classrooms. The stationary chairs can have many different configurations, such as four leg chairs, cantilever leg chairs and chairs with a sled base. These chairs provide for stable support on a floor of the classroom.

In classrooms that include students that have trouble sitting still, there is a desire for chairs that rock for use with these students. Rocking chairs can be particularly helpful for students that have attention deficit issues since the rocking movement can help these students maintain a calm demeanor. However, rocking chairs may not be desirable for all of the students in a classroom since the rocking movement can be a distraction for other students.

Therefore, there is a desire for a system that allows existing or future standard chairs to be changed or converted into rocking chairs. Such a system could be used to adapt stationary chairs on an as needed basis for each of the individual students. Additionally, such a system would allow the converted rocking chairs to return to a standard chair as desired.

SUMMARY

The present disclosure relates to a system that allows for the conversion of a stationary chair to a rocking chair through the use of a pair of rocker assemblies. The rocker assemblies can be selectively installed and removed from the legs of a stationary chair to transition the chair between a stationary condition and a rocking condition.

The system of the present disclosure includes a pair of rocker assemblies that are each configured to be securely mounted to one of a pair of horizontal leg portions of a chair. The horizontal leg portions are designed to support the chair on a floor during normal use of the chair. When the pair of rocker assemblies are installed on the chair, the pair of rocker assemblies contact the floor to support the chair on the floor and to allow rocking movement of the chair.

The pair of rocker assemblies are similar to each other, and each include a first rocker bracket and a second rocker bracket that are configured to be secured to each other to entrap one of the horizontal leg portions between the first and second rocker brackets. In one contemplated embodiment, the first and second rocker brackets are identical components and are connected to each other by a plurality of connectors.

Each of the first and second rocker brackets includes a rocker surface that is designed to contact the floor when the rocker assemblies are attached to the legs of the chair. The rocker surfaces each have an arcuate shape that extends between front and back ends and have a fulcrum point between the front and back ends. When the first and second rocker brackets are installed, the chair is supported at the fulcrum point of each bracket. Since the rocker surfaces each have an arcuate shape, the seat occupant can rock back and forth along the rocker surfaces.

In one contemplated embodiment, each of the first and second rocker brackets include a support block. The support block is formed as part of the rocker bracket and is designed to contact the horizontal leg portion. Specifically, the horizontal leg portion is located above the support block when the rocker brackets are attached to the leg portion. In this manner, the support blocks provide support for the chair legs above the rocker surfaces.

In another contemplated embodiment, a chair that is configurable between a stationary condition and a rocking condition is disclosed. The chair includes a seating portion that is supported by a plurality of legs that include at least a pair of horizontal leg portions. The horizontal leg portions support the chair on the floor in the stationary condition.

The chair includes a pair of rocker assemblies that are each configured to be securely mounted to one of the horizontal leg portions such that when the pair of rocker assemblies are mounted to the chair legs, the chair is in the rocking condition and the rocker assemblies support the chair on the floor.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
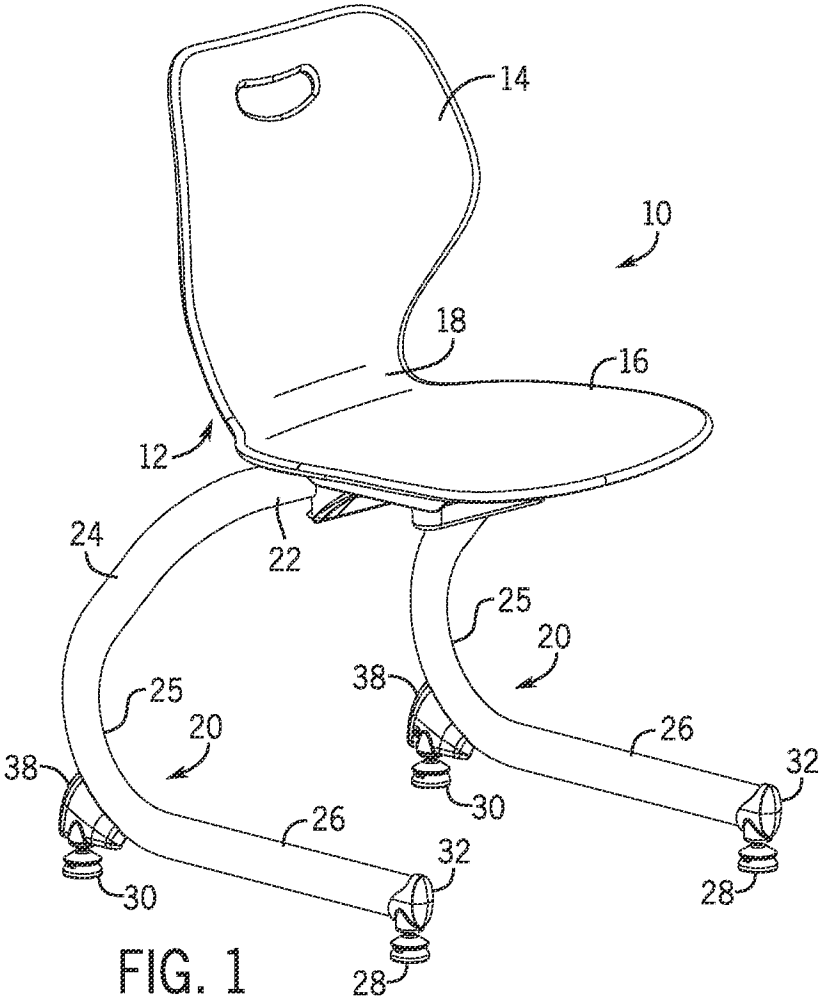
FIG. 1 is a perspective view of a stationary chair having cantilever style legs.

FIG. 1 illustrates a standard, stationary chair 10 that can be utilized with the system of the present disclosure. The chair 10 shown in FIG. 1 includes a seating portion 12 that includes both a chair back 14 and a seat 16. In the embodiment shown in FIG. 1, the chair back 14 and the seat 16 are formed as a single component that are joined to each other along a center portion 18 that allows the chair back 14 to flex relative to the seat. However, the chair 10 could be configured in many different manners, such as in a configuration in which the chair back 14 and the seat 16 are formed as separate components joined to each other by some type of frame assembly.

In the embodiment shown in FIG. 1, the chair 10 is a cantilever style chair in which the seating portion 12 is supported above a floor by a pair of cantilever legs 20. In the embodiment shown in FIG. 1, the cantilever legs 20 are formed from a single continuous section of metal tubing that is bent into the configuration shown. In the shown configuration, each of the cantilever legs 20 includes an upper portion 22 that is joined to a bottom surface of the seating portion 12. The upper portion 22 of each leg 20 transitions into a downtube 24 that has a curved portion 25 that transitions into a horizontal leg portion 26. In the embodiment illustrated, the upper portion 22, downtube 24, curved portion 25 and horizontal leg portion 26 are formed from the same tubular material. In the illustrated embodiment, both of the pair of cantilever legs 20 can be formed from the same tubular material that is bent to the configuration shown in FIG. 1; however the pair of cantilever legs 20 could be formed from separate sections of tubular material.

In the embodiment shown in FIG. 1, each of the cantilever legs 20 includes a front foot 28 and a rear foot 30 that support the horizontal leg portion 26 on the floor. In the embodiment illustrated, both the front foot 28 and the rear foot 30 automatically adjust to level out the chair on the floor to reduce wobbling or instability. In the embodiment shown, the front foot 28 is movably mounted within an end cap 32 mounted to an outer end 34 of the horizontal leg portion 26. The rear foot 30 extends from a mounting bracket 38 positioned at the curved portion 25 that transitions between the downtube 24 and the horizontal leg portion 26. In the embodiment shown, the front foot 28 and the rear foot 30 movable to allow the vertical position of the front foot 28 and the rear foot 30 to be adjust to level the stationary chair 10 on a floor surface.

Although the chair 10 is shown in the embodiment of FIG. 1 as being a stationary chair having cantilever-style legs, it should be understood that the subject matter of the present disclosure could be used equally with different types of chairs that include some type of horizontal leg portion that is used to generally support the chair 10 on a floor. As an illustrative example, the chair 10 could be a conventional sled-type chair that includes a pair of generally vertical front legs and a pair of generally vertical back legs that are joined to each other by a horizontal leg portion. In such an embodiment, the horizontal leg portion would support the chair on a floor and could be utilized with the subject matter of the present disclosure.

Figure 2:
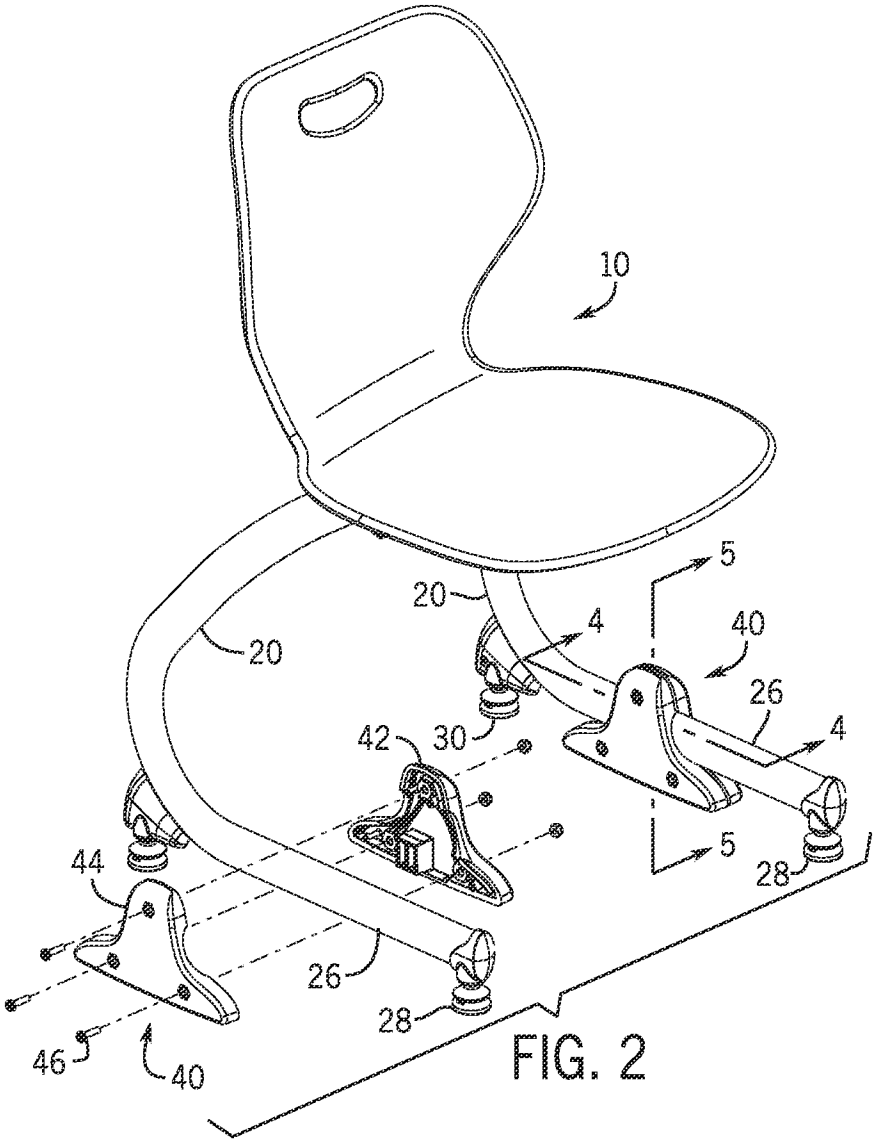
FIG. 2 is a perspective view of the stationary chair with cantilever style legs that includes the system of the present disclosure for modifying the stationary chair to a rocking chair.

FIG. 2 illustrates the stationary chair 10 with the system of the present disclosure that allows the chair 10 to be converted from a stationary condition shown in FIG. 1 to a rocking condition through the use of a pair of rocker assemblies 40. Each of the rocker assemblies 40 can be securely mounted to one of the lower leg portions 26 to convert the chair 10 from a stationary chair to a rocking chair. Each of the rocker assemblies 40 can be selectively mounted to and removed from the horizontal leg portion 26 to convert the chair between the two conditions. In the embodiment shown in FIG. 2, the rocker assembly 40 includes a first rocker bracket 42 and a second rocker bracket 44 that combine to entrap the horizontal leg portion 26 between the pair of rocker brackets 42, 44. A series of connectors 46 are used to secure that first rocker bracket 42 to the second rocker bracket 44 in the assembled condition shown on the left leg of the chair in FIG. 2.

Figure 3:
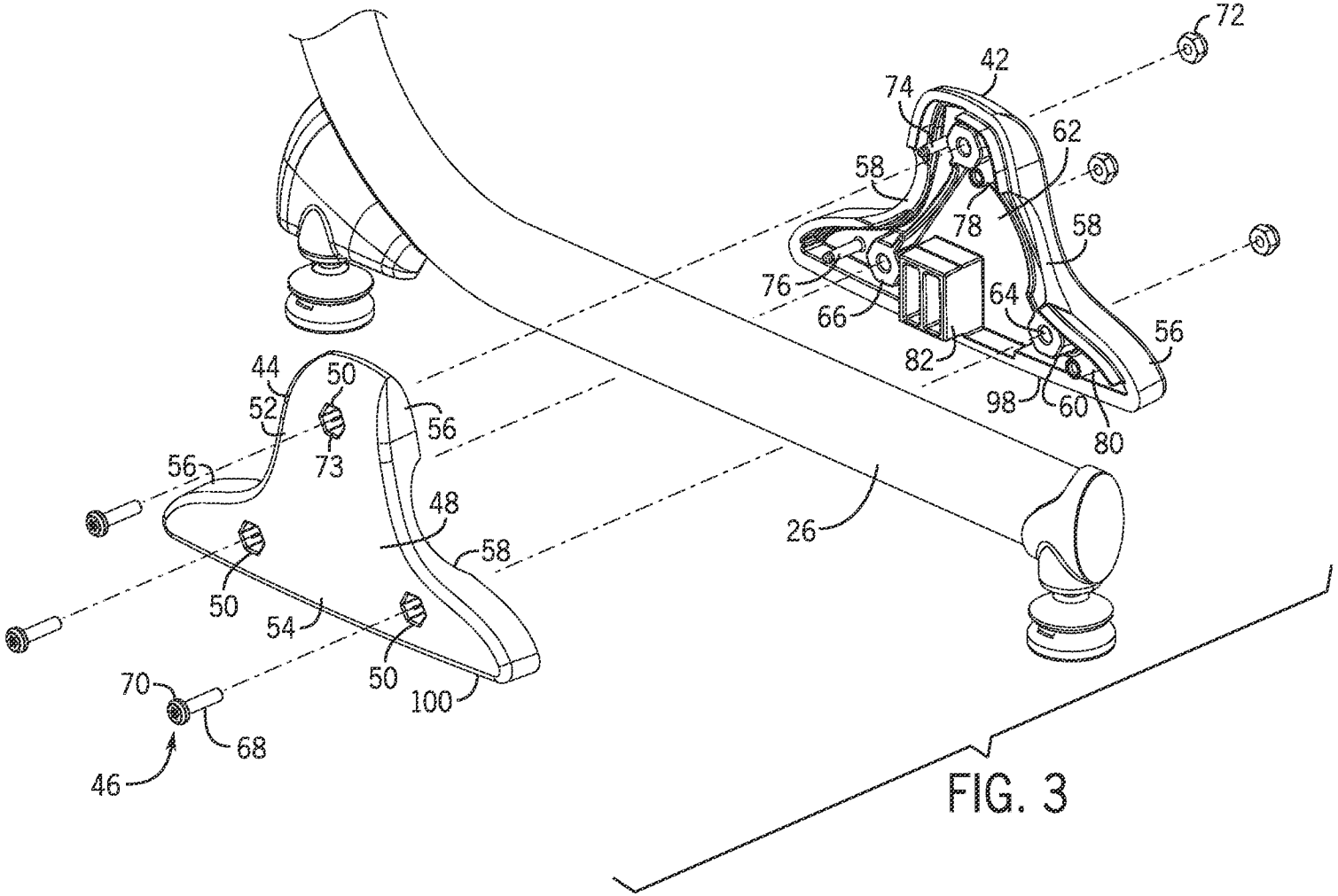
FIG. 3 is an exploded, magnified view of the system for modifying the stationary chair to a rocking chair.

FIG. 3 is a magnified and exploded view of the rocker assembly 40 showing the first rocker bracket 42 and the second rocker bracket 44 in an exploded condition prior to being installed on the horizontal leg portion 26. In the embodiment illustrated, the first rocker bracket 42 and the second rocker bracket 44 are identical components and are each formed from a molded plastic material. The second rocker bracket 44 is rotated 180 degrees relative to the first rocker bracket 42 prior to installation onto the horizontal leg portion 26. In this manner, a common component can form both the first rocker bracket 42 and the second rocker bracket 44 such that only one part needs to be formed and maintained in inventory.

The rocker brackets 42, 44 each include a generally smooth outer surface 48 that includes three connector openings 50. One of the connector openings 50 is formed in an upper portion 52 of the rocker bracket while two of the connector openings 50 are formed in a lower portion 54 of the rocker bracket. The upper and lower portions 52, 54 are defined by a pair of sidewalls 56. Each of the opposite sidewalls 56 includes a relieved area that forms a cradle 58 that generally has a configuration designed to closely correspond to the outer surface of the horizontal leg portion 26. Thus, when the first and second rocker brackets 42, 44 are mated with each other, the outer surface of the horizontal leg portion 26 is received within the mating cradles 58 to help maintain contact between the rocker brackets 42, 44 and the outer surface of the horizontal leg portion 26.

As can be seen in FIG. 3, each of the connector openings 50 extends into a standoff 60 that extends away from the inner surface 62 of the rocker bracket. Each of the standoffs 60 includes a center opening 64 that extends from the outer surface 48 to a generally flat standoff surface 66. The standoff 60, and specifically the opening 64, is designed to allow the shaft 68 of each of the connectors 46 to extend through the pair of mated rocker brackets 42, 44. In the embodiment shown in FIG. 3, each of the connectors 46 is a bolt having a head 70 and a threaded shaft 68. The threaded shaft 68 extends through the rocker bracket 44 is received by a threaded nut 72 received and supported by the rocker bracket 42. The nut 72 has a hexagonal outer surface that corresponds to the hexagonal inner surface 73 formed at each of the connector openings 50. In this manner, the shape and configuration of the connector openings 50 prevents the nut 72 from rotation during installation and receipt of the threaded shaft 68.

In addition to the use of the connectors 46, each of the rocker brackets 42, 44 includes an upper peg 74 and a lower peg 76 that extend away from the inner surface 62. The upper peg 74 and the lower peg 76 are each designed to be received within a corresponding upper receptacle 78 and a lower receptacle 80 that each also extend from the inner surface 62. As can be understood in FIG. 3, when the first rocker bracket 42 and the second rocker bracket 44 are installed on the horizontal leg portion 26, the upper peg 74 of the first rocker bracket 42 is received in the corresponding upper receptacle 78 in the second rocker bracket 44. Likewise, the lower peg 76 on the first rocker bracket 42 is received in the corresponding lower receptacle 80 formed in the second rocker bracket 44. Each of the pegs 74, 76 can include a serrated outer end to help hold the pegs 74, 76 in the corresponding receptacles 78, 80.

Figure 4:
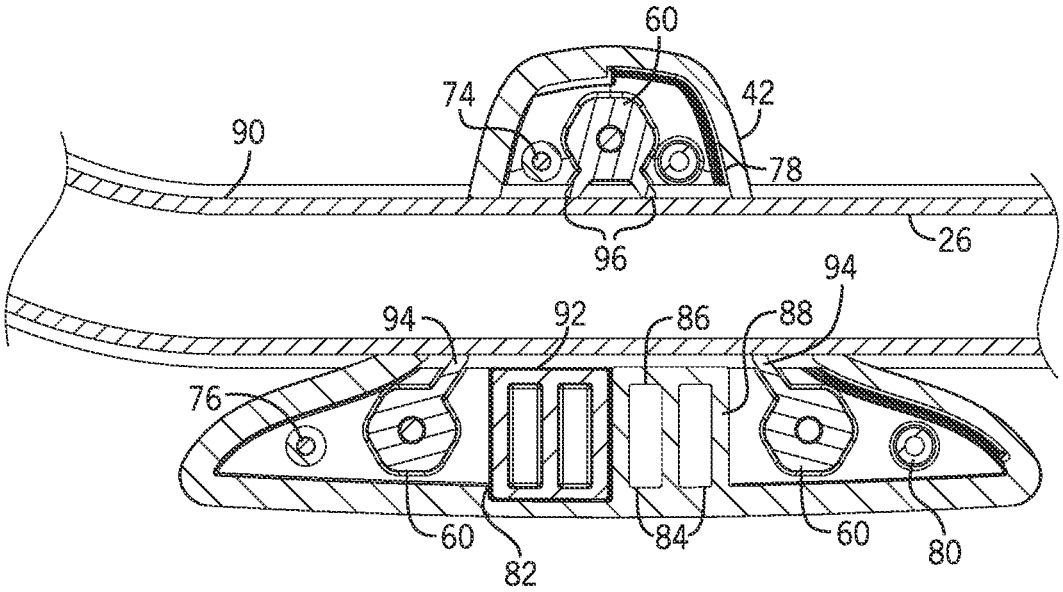
FIG. 4 is a section view taken along line 4-4 of FIG. 2.
Figure 5:
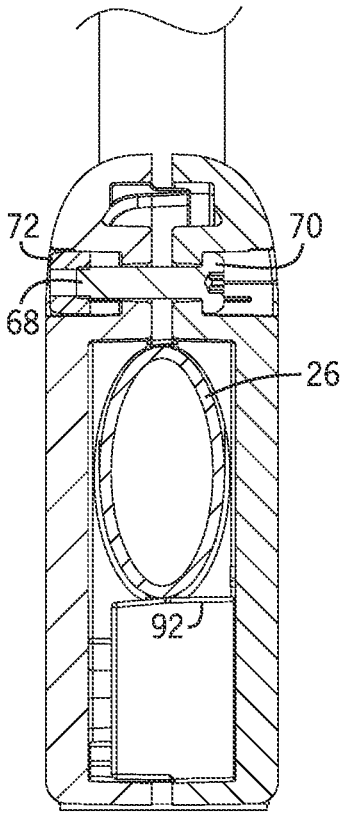
FIG. 5 is a section view taken along line 5-5 of FIG. 2.

As shown in FIGS. 3 and 4, each of the first and second rocker brackets 42, 44 include a support block 82 that extends from the inner surface 62. The support block 82 has a generally rectangular shape that includes a pair of open areas 84 that are separated by a center wall 86 and defined by a pair of end walls 88. The open areas reduce the amount of material needed to form the support blocks 82. As shown in FIG. 4, when the first rocker bracket 42 is installed on the horizontal leg portion 26, the outer surface 90 of the horizontal leg portion 26 contacts and is supported by the top surface 92 of the support block 82. Such contact can also be seen in the section view taken and shown in FIG. 5.

As also shown in FIG. 4, each of the standoffs 60 includes an extended support tab 94 that also contacts the outer surface 90 of the horizontal leg portion 26 to provide additional stability for the rocker bracket 42. The upper standoff 60 includes a pair of support tabs 96 that also provide support for the rocker bracket 42 along the horizontal leg portion 26.

Figure 6:
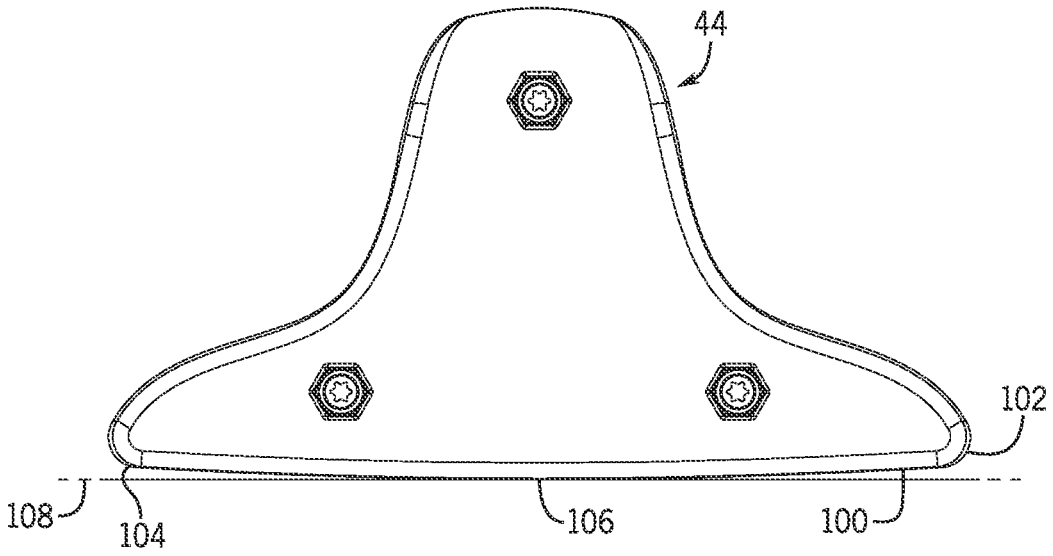
FIG. 6 is a side view showing the interaction of the side bracket with a ground surface to facilitate rocking movement.

Referring back to FIG. 3, the first rocker bracket 42 includes a first arcuate rocker surface 98 while the second rocker bracket includes a corresponding second arcuate rocker surface 100. Since both of the first and second rocker brackets 42, 44 are identical, the pair of rocker surfaces 98, 100 are also identical. FIG. 6 most clearly illustrates the configuration and operation of the rocker surface 100 on the second rocker bracket 44. It should be understood that the first rocker surface 98 on the first rocker bracket 42 is identical thereto. The rocker surface 100 has a generally smooth outer surface that has an arcuate shape extending from a front end 102 to a back end 104. The center of the rocker surface 100 includes a fulcrum point 106. The fulcrum point 106 is the vertically lowest portion of the rocker surface 100 and is the point of the rocker bracket 44 that contacts the floor 108, as shown in FIG. 6. When the fulcrum point 106 is in contact with the floor 108, both the front end 102 and the back end 104 are spaced above the floor 108. The spacing between the front and back ends 102, 104 of the rocker bracket 44 and the floor 108 allow the entire chair to rock along the rocker surface 100 in a known and desired manner.

Figure 7:
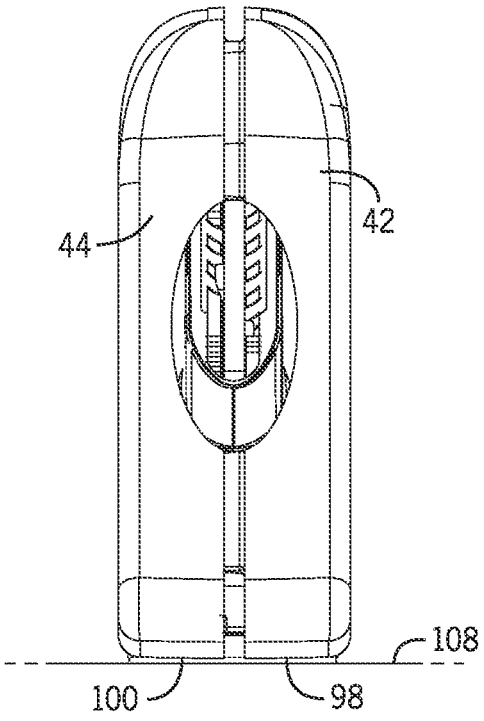
FIG. 7 is an end view of the side brackets showing the interaction with the ground surface.
Figure 8:
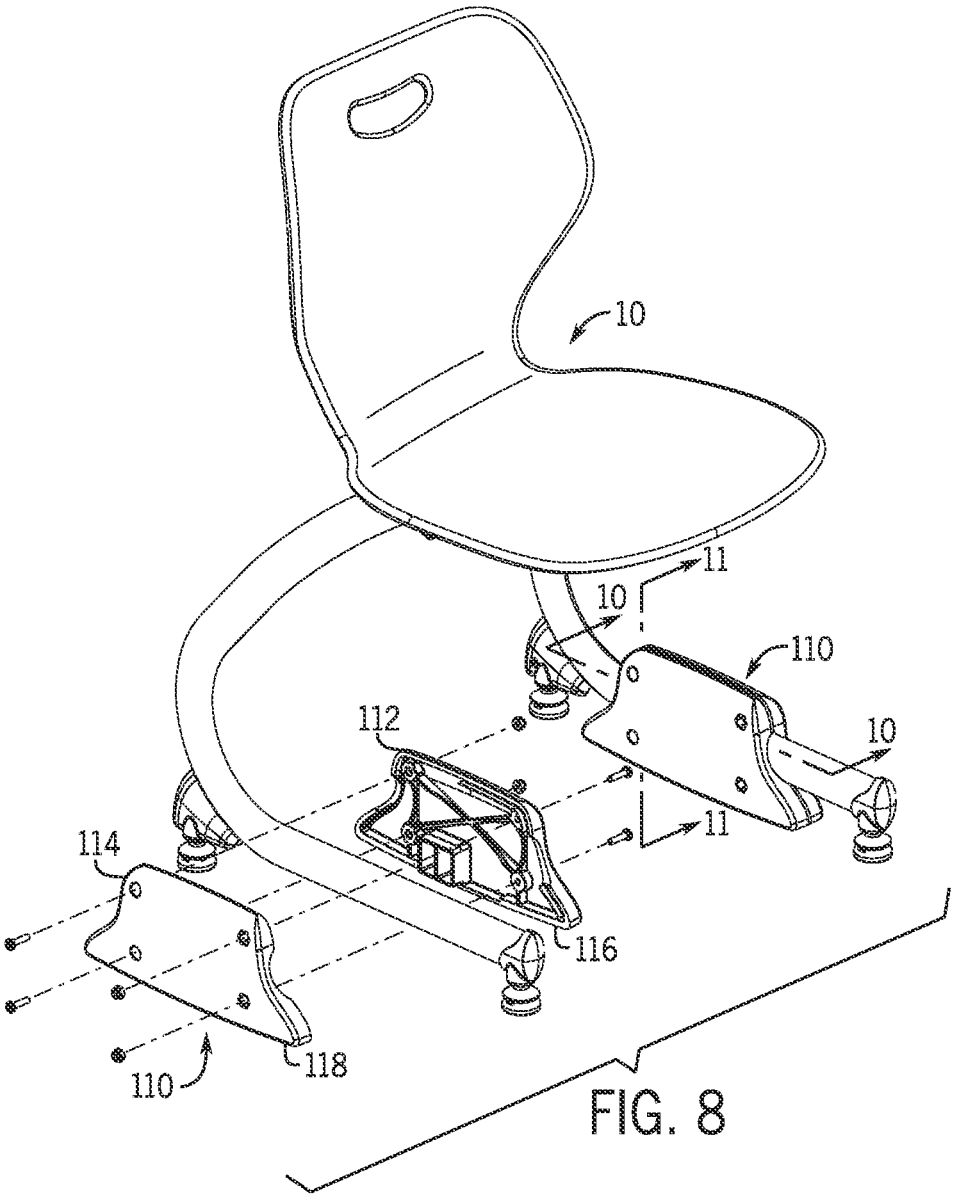
FIG. 8 is an exploded perspective view of a second embodiment of the system for modifying the stationary chair into a rocking chair.

As shown in FIG. 7, the first and second rocker surfaces 98, 100 contact the floor 108 to support the entire chair at the pair of fulcrum points. When a user shifts weight either forward or back relative to the fulcrum point 106, the chair including the rocker assemblies rocks in a desirable manner.

Referring back to FIG. 2, when the rocker assemblies 40 are installed onto the pair of spaced cantilever legs 20, the pair of front feet 28 and the pair of rear feet 30 are retracted as far as possible to allow for the rocking movement of the chair. In this manner, the pair of rocker assemblies 40 transition the chair 10 from the stationary condition shown in FIG. 1 to a rocking condition shown in FIG. 2.

FIGS. 8-13 illustrate a second embodiment of the rocker assemblies 110. The second embodiment of the rocker assemblies 110 function in the same manner as the rocker assemblies 40 shown in the first embodiment of FIGS. 2-7. However, in the second embodiment of the rocker assemblies 110, each of the first rocker brackets 112 and second rocker brackets 114 have a larger size and a longer first rocker surface 116 and second rocker surface 118. The longer rocker surfaces 116 and 118 increase the amount of rocking possible for the chair 10. As in the first embodiment, each of the rocker assemblies 110 can be selectively installed on the chair 10 to transition the chair from a stationary condition to a rocking condition.

Figure 9:
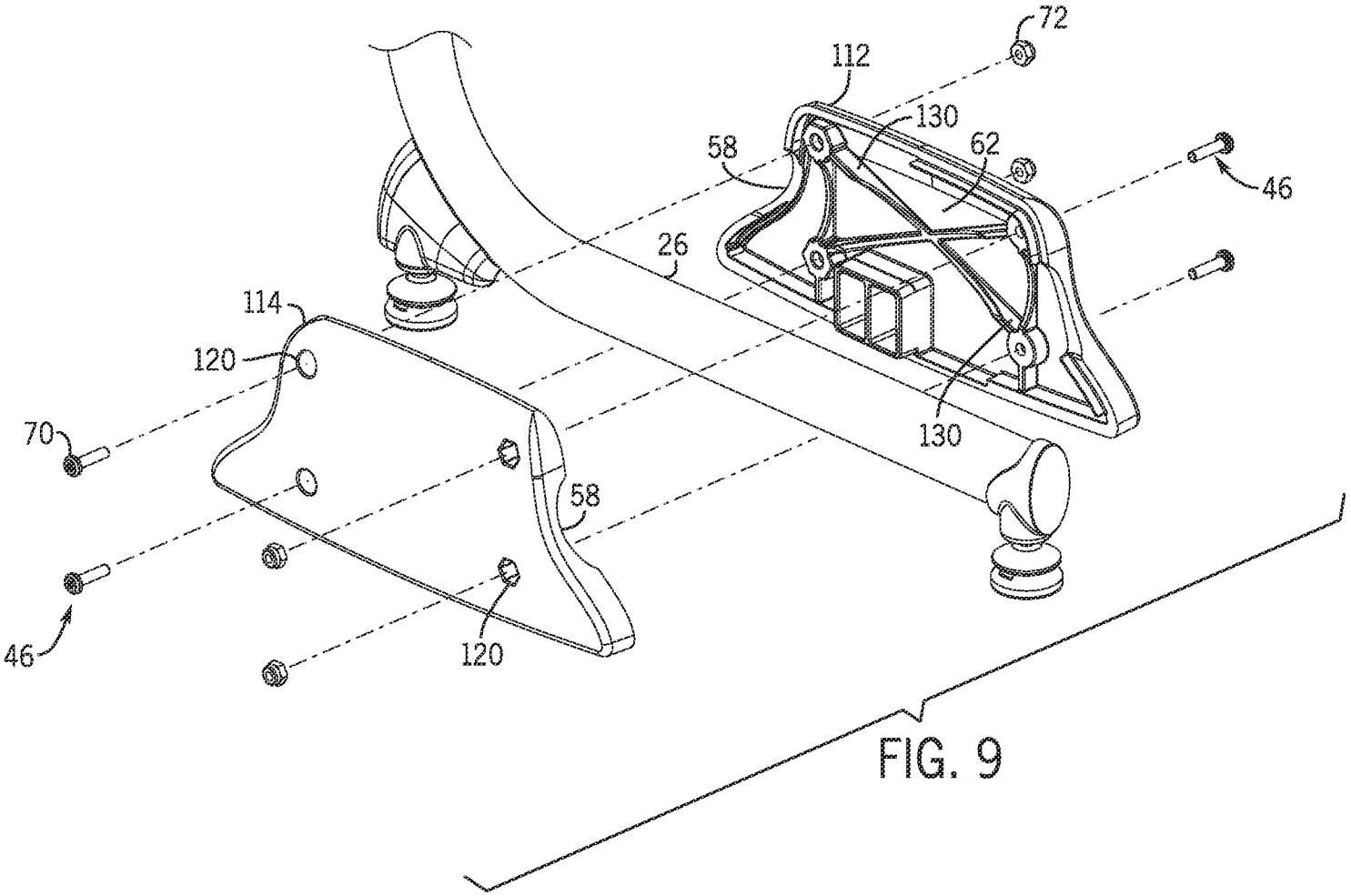
FIG. 9 is an exploded, magnified view of the second embodiment of the system for modifying the stationary chair into a rocking chair.

As can be seen in FIG. 9, each of the rocker brackets 112 and 114 includes four connector openings 120 that each receive one of the connectors 46. In the embodiment shown in FIG. 9, a pair of the connectors 46 extends through the first rocker bracket 112 while a second pair of connectors 46 extend through the second rocker bracket 114. As can be further seen in FIG. 9, a pair of the connector openings 120 includes a hexagonal inner diameter while a second pair of the connector openings includes a generally circular opening.

Figure 10:
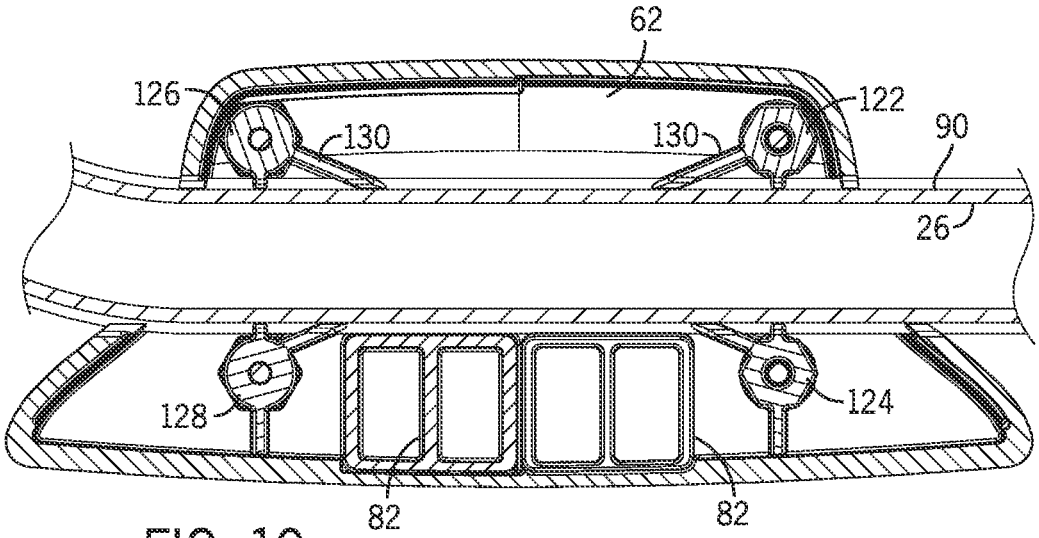
FIG. 10 is a section view taken along line 10-10 of FIG. 8.
Figure 11:
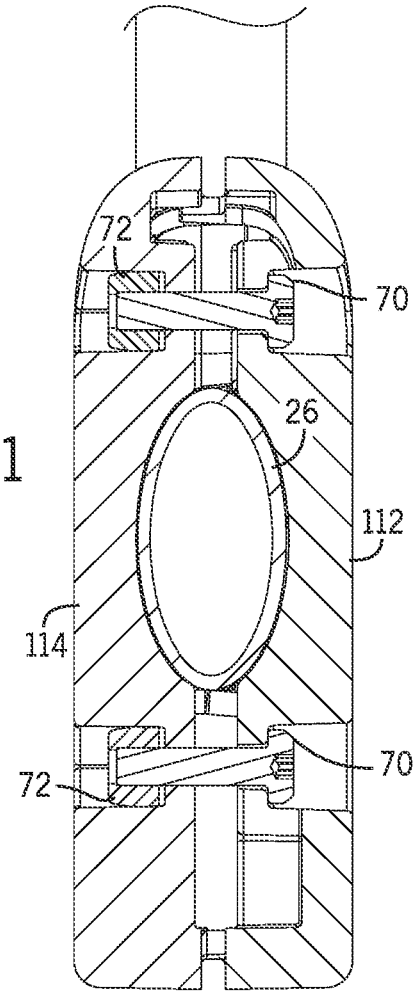
FIG. 11 is a section view taken along line 11-11 of FIG. 8.

Referring now to FIG. 10, two different types of standoffs extend from the inner surface 62. The first type of standoff is shown by the upper standoff 122 and the lower standoff 124. Both of the two standoffs have a generally hexagonal outer surface. A second type of standoff, shown as the upper standoff 126 and lower standoff 128 have a smooth outer surface. The hexagonal outer surface of the upper and lower standoffs 124 are used to secure the hexagonal surface of the nut 72 while the smooth surface of the standoffs 126, 124 allow for easier access of the head portion 70 of each of the connectors 46.

As shown in FIG. 9, like the first embodiment, each of the first and second rocker brackets 112, 114 includes a cradle 58 that is sized to receive and engage the outer surface of the leg portion 26. The inner surface 62 of each of the rocker brackets includes a pair of cross supports 130 that provide additional support for the molded plastic piece having an increased size. A center section of the cross supports 130 is removed to further aid in receiving the outer surface of the leg portion 26, as best shown in FIG. 10. As with the first embodiment, each of the rocker brackets includes a support block 82 that further aids in supporting the rocker bracket on the leg portion 26.

Figure 12:
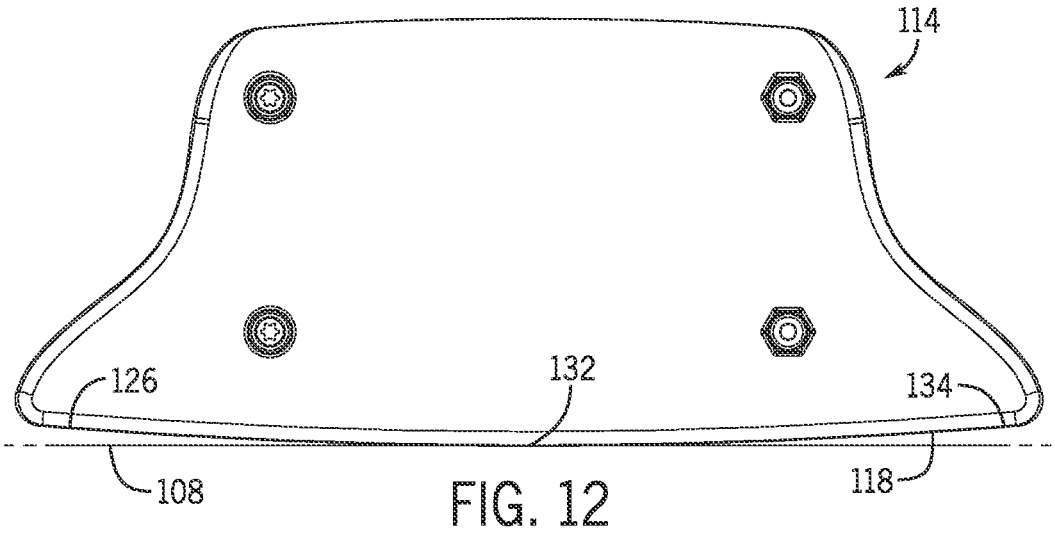
FIG. 12 is a side view showing the interaction of the side bracket with a ground surface to facilitate rocking movement.
Figure 13:
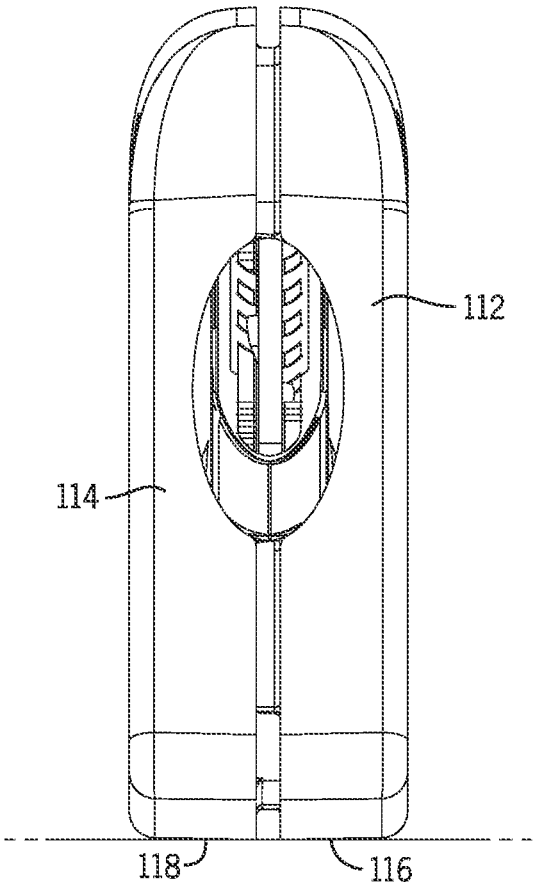
FIG. 13 is an end view of the side brackets showing the interaction with the ground surface.

Referring now to FIG. 12, the rocker surface 118 includes a fulcrum point 132 between the front end 134 and the back end 136. As illustrated, both the front end 134 and the back end 136 are spaced above the floor 108 by a distance greater than the spacing shown in the first embodiment of FIG. 6. Such spacing allows for additional rocking movement of the chair when the second embodiment of the rocker assemblies 110 are installed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for converting a chair having at least a pair of horizontal leg portions that rest on a floor and are located on opposite sides of the chair into a rocking chair, comprising:

a pair of rocker assemblies each configured to be securely mounted to one of the horizontal leg portions such that when the pair of rocker assemblies are securely mounted to the leg portions, the rocker assemblies contact the floor to support the chair on the floor, each of the rocker assemblies comprising:

a first rocker bracket including a first rocker surface;

a second rocker bracket including a second rocker surface, wherein the first and second rocker brackets are configured to entrap one of the horizontal leg portions between the first and second rocker bracket such that the first and second rocker surfaces contact the support surface and space the horizontal leg portion above the floor; and a plurality of connectors to securely connect the first rocker bracket to the second rocker bracket.

2. The system of claim 1 wherein the first rocker bracket includes a first support block positioned above the first rocker surface and the second rocker brackets includes a second support block positioned above the second rocker surface.

3. The system of claim 2 wherein the horizontal leg portion is positioned above and in contact with the first and second support blocks when the first and second rocker brackets are attached to the horizontal leg portion.

4. The system of claim 1 wherein each of the first and second rocker brackets are formed from molded plastic.

5. The system of claim 1 wherein the first and second rocker surfaces are each arcuate surfaces extending from a front end to a back end and having a fulcrum contact point located below the front and back ends when the rocker assemblies are attached to the chair.

6. The system of claim 1 wherein the first rocker bracket and the second rocker bracket are identical, and the second rocker bracket is rotated relative to the first rocker bracket before connection to the horizontal leg portion.

7. A chair configurable between a stationary condition and a rocking condition, comprising:

a seating portion having a seat and a chair back;

a plurality of legs extending below the seat, the plurality of legs including at least a pair of horizontal leg portions located below and on opposite sides of the seat;

a pair of rocker assemblies each configured to be securely mounted to one of the horizontal leg portions such that when the pair of rocker assemblies are securely mounted to the leg portions, the chair is in the rocking condition in which the rocker assemblies contact a floor to support the chair on the floor, wherein each of the pair of rocker assemblies comprise:

a first rocker bracket including a first rocker surface and a first support block positioned above the first rocker surface;

a second rocker bracket including a second rocker surface and a second support block, wherein the first and second rocker brackets are configured to entrap one of the horizontal leg portions between the first and second rocker bracket such that the first and second rocker surfaces contact the floor and space the leg portion above the floor; and a plurality of connectors to securely connect the first rocker bracket to the second rocker bracket.

8. The chair of claim 7 wherein the horizontal leg portion is positioned above and in contact with the first and second support blocks when the first and second rocker brackets are attached to the horizontal leg portion.

9. The chair of claim 7 wherein each of the first and second rocker brackets are formed from molded plastic.

10. The chair of claim 7 wherein the first and second rocker surfaces are each arcuate surfaces extending from a front end to a back end and having a fulcrum contact point located below the front and back ends when the rocker assemblies are attached to the chair.

11. The chair of claim 7 wherein the first rocker bracket and the second rocker bracket are identical, and the second rocker bracket is rotated relative to the first rocker bracket before connection to the horizontal leg portion.

12. The chair of claim 7 further comprising a pair of feet mounted to each of the horizontal leg portions, wherein the feet contact the floor to support the chair in the stationary condition.

13. The chair of claim 12 wherein the pair of rocker assemblies extend below the feet when the rocker assemblies are mounted to the horizontal leg portions.

14. The chair of claim 7 wherein the plurality of legs includes a first cantilever leg and a second cantilever leg that are joined to each other.

15. A chair configurable between a stationary condition and a rocking condition, comprising:

a seating portion having a seat and a chair back;

a plurality of legs extending below the seat, the plurality of legs including at least a pair of horizontal leg portions located below and on opposite sides of the seat;

a pair of rocker assemblies each configured to be securely mounted to one of the horizontal leg portions such that when the pair of rocker assemblies are securely mounted to the leg portions, the chair is in the rocking condition in which the rocker assemblies contact a floor to support the chair on the floor, each of the rocker assemblies comprising:

a first rocker bracket including a first rocker surface; and a second rocker bracket including a second rocker surface, wherein the first and second rocker brackets are configured to be joined to each other to entrap one of the horizontal leg portions between the first and second rocker bracket such that the first and second rocker surfaces contact the floor and space the leg portion above the floor.

16. The chair of claim 15 wherein the first and second rocker surfaces are each arcuate surfaces extending from a front end to a back end and having a fulcrum contact point located below the front and back ends when the rocker assemblies are attached to the chair.

17. The chair of claim 16 wherein the first rocker bracket and the second rocker bracket are identical, and the second rocker bracket is rotated relative to the first rocker bracket before connection to the horizontal leg portion.

* * * * *